US006098544A

United States Patent [19]

Figov

[11] Patent Number: 6,098,544

[45] **Date of Patent: *Aug. 8, 2000**

[54] SHORT RUN OFFSET PRINTING MEMBER

[75] Inventor: Murray Figov, Ra'anana, Israel

[73] Assignee: CreoScitex Corporation Ltd., Herzelia, Israel

[ * ] Notice: This patent issued on a continued prosecution application filed under 37 CFR 1.53(d), and is subject to the twenty year patent term provisions of 35 U.S.C. 154(a)(2).

[21] Appl. No.: 09/021,588

[22] Filed: Feb. 10, 1998

[30] Foreign Application Priority Data

Apr. 1, 1997 [IL] Israel ..... 120588

[51] Int. Cl.[7] ..... B41N 1/14

[52] U.S. Cl. ..... 101/457; 101/462

[58] Field of Search ..... 101/454, 457, 101/458, 459, 460, 462, 463.1, 465, 466, 467

[56] References Cited

U.S. PATENT DOCUMENTS

| | | | |
|---|---|---|---|
| 3,945,318 | 3/1976 | Landsman | 467/101 |
| 4,054,094 | 10/1977 | Caddell et al. | 101/467 |
| 4,086,853 | 5/1978 | Figov et al. | 101/459 |
| 4,617,579 | 10/1986 | Sachdev et al. | 101/462 |
| 4,693,958 | 9/1987 | Schwartz et al. | 430/302 |
| 5,188,032 | 2/1993 | Lewis et al. | 101/453 |
| 5,339,737 | 8/1994 | Lewis et al. | 101/454 |
| 5,351,617 | 10/1994 | Williams et al. | 101/467 |
| 5,353,705 | 10/1994 | Lewis et al. | 101/453 |
| 5,401,611 | 3/1995 | Edwards, Sr. et al. | 4300/276 |
| 5,487,338 | 1/1996 | Lewis et al. | 101/454 |
| 5,493,971 | 2/1996 | Lewis et al. | 101/454 |
| 5,605,780 | 2/1997 | Burberry et al. | 430/278.1 |
| 5,638,753 | 6/1997 | Lewis et al. | 101/467 |
| 5,783,364 | 7/1998 | Ellis et al. | 101/467 |
| 5,807,658 | 9/1998 | Ellis et al. | 101/467 |

FOREIGN PATENT DOCUMENTS

WO 97/27065 1/1997 WIPO .

OTHER PUBLICATIONS

Thompson, "Printing Materials: Science and Technology", Pira International (1998) p. 477.

Leach et al. (ed.),"The Printing Ink Manual", 5$^{th}$ ed. (1993) p. 20.

Owen, "Printing Inks For Lithography", SITA Technology, London (1990) pp. 16–17.

*Primary Examiner*—Stephen R. Funk

*Attorney, Agent, or Firm*—Darby & Darby

[57] ABSTRACT

A short run offset printing member is provided which includes a substrate layer that is substantially oleophilic to conventional hydrocarbon-based printing inks, with a second infra-red radiation ablatable and hydrophilic layer over it. The infra-red radiation ablatable layer is coupled with an infra-red radiation absorbing covering to permit ablation of the infra-red radiation ablatable layer.

19 Claims, 4 Drawing Sheets

SHORT RUN OFFSET PRINTING MEMBER

FIELD OF THE INVENTION

The present invention relates to printing members for offset lithography and in particular to infra-red radiation imagible offset printing plates for use in short run offset lithographic printing processes.

BACKGROUND OF THE INVENTION

Offset lithographic printing is a widely used printing method. This is in large part due to the relative ease, with which offset lithographic printing plates can be produced. Contemporary offset lithographic plate preparation includes using specially prepared masking films, to selectively harden or soften (according to the chemistry of the plate) portions of the surface of the plate using imaging by exposure to ultra-violet radiation. The plate is subsequently developed during which the soluble regions of the plate surface are washed away.

With the onset of digital technology, computer generated digital information is printed onto plates directly, but the plates still employ the masking films. Contemporary masking films are silver based, and as such exhibit substantial drawbacks.

Initially, these films are expensive, as silver is a non-renewable resource, and are extremely vulnerable to price fluctuations based on market conditions. The chemicals for processing silver films are also expensive. An even greater problem is that the spent silver and chemical wastes from processing are highly toxic and thus, environmentally harmful. Proper disposal of these materials is expensive, for it must be done in an environmentally safe manner, by sophisticated methods. Additionally, silver films are temperature and visible light sensitive, and thus, processing must always be performed and the films maintained under controlled conditions.

Another approach involves laser imaging of printing blanks. For example, U.S. Pat. No. 4,054,094 (Caddell, et al.) discloses a system for imaging a printing member (or blank), the blank having a thin hard hydrophilic coating on a polymer, this polymer being coated on a polymeric or metal base. A high energy, carbon-dioxide laser etches (or ablates) away the layers to expose the material of the base, this material being oleophilic.

In U.S. Pat. No. 4,693,958 (Schwartz, et al.), high energy laser radiation of 10 watts, hardens a printing member (plate) having a water soluble coating. The nonimaged and unhardened non imaged areas are washed away to expose a hydrophilic aluminum substrate. The film thickness to be hardened is at least 0.2 microns (micrometers).

A further trend in offset printing technology is market based, and in particular toward short run printing. This is because the number of copies printed at a single location is declining, due to the high cost of warehousing and shipping. Rather, local printing in short runs is becoming popular, as it saves on warehousing and shipping, and in particular postage.

SUMMARY OF THE INVENTION

The present invention constitutes an improvement in the art of wet offset lithography, where a printing member, e.g., a printing plate, is wetted with water-based fountain solution (commonly known as fount) or the like prior to inking and transfer of the inked image. The present invention is directed to printing members, e.g., printing plates, that are used in short printing runs (typically less than 5000 copies) that are not sensitive to visible light, are imaged with low energy infra-red radiation, preferably from a low energy laser, either on or off press, and are, thus, inexpensive to produce.

The printing members disclosed utilize the differences in the properties of the material layers from which they are formed. These printing members comprise a first or substrate layer that is of a material oleophilic to conventional hydrocarbon-based printing inks, with a second layer that is ablatable and hydrophilic over it. The second layer is suitable for coverage with a radiation absorbing covering, that couples with the second layer, in order for the substantial removal of portions of both this covering and the second layer, preferably by ablation with infra-red radiation. The radiation absorbing covering may be the form of a coating, such as an ink, pigment, or dye, or a third layer. These portions of the radiation absorbing covering and the second layer, substantially removed by ablation, correspond to the image desired to be printed, and once removed, leave exposed corresponding portions of the first or substrate layer that carry the ink or inks. The radiation absorbing covering may be water soluble, water miscible or of low adhesion to the second layer, as to be easily removable by contact with water based fountain solution(s) (fount), etchants, or a water wash.

Preferably, this radiation absorbing covering is removed post ablation and prior to the inking of the printing member, such that a printing member with the first and second layers remaining is subject to inking. The now remaining hydrophilic second layer accepts water or fount, upon wetting, making it substantially abhesive to the hydrocarbon-based ink(s), the ink(s) applied post wetting, and retained by the exposed portions of the first or substrate layer. The now inked printing member is ready for subsequent steps in the requisite printing operation.

BRIEF DESCRIPTION OF THE DRAWINGS

The present invention will be described with reference to the accompanying drawings, wherein like reference numerals identify corresponding or like components.

In the drawings.

DETAILED DESCRIPTION OF THE DRAWINGS

The present invention is directed to printing members, preferably in the form of sheet-like plates. As used herein, the term "plate" refers to any structure capable of having an image recorded thereon, that has different regions thereof, corresponding to the recorded image, these different regions exhibiting different affinities for various conventional hydrocarbon (and water) based printing inks. These plates may be in configurations including those of traditional planar or curved lithographic plates that are commonly mounted on plate cylinders of conventional offset printing apparatus and the like. These plates are preferably designed for imaging with radiation in the infra-red region of the spectrum, between the visible and microwave regions of the spectrum, with wavelengths, that range from approximately 0.75 micrometers to approximately 1000 micrometers. See, Chambers Science and Technology Dictionary, W&R Chambers, Ltd. (1991).

Figure 1A:
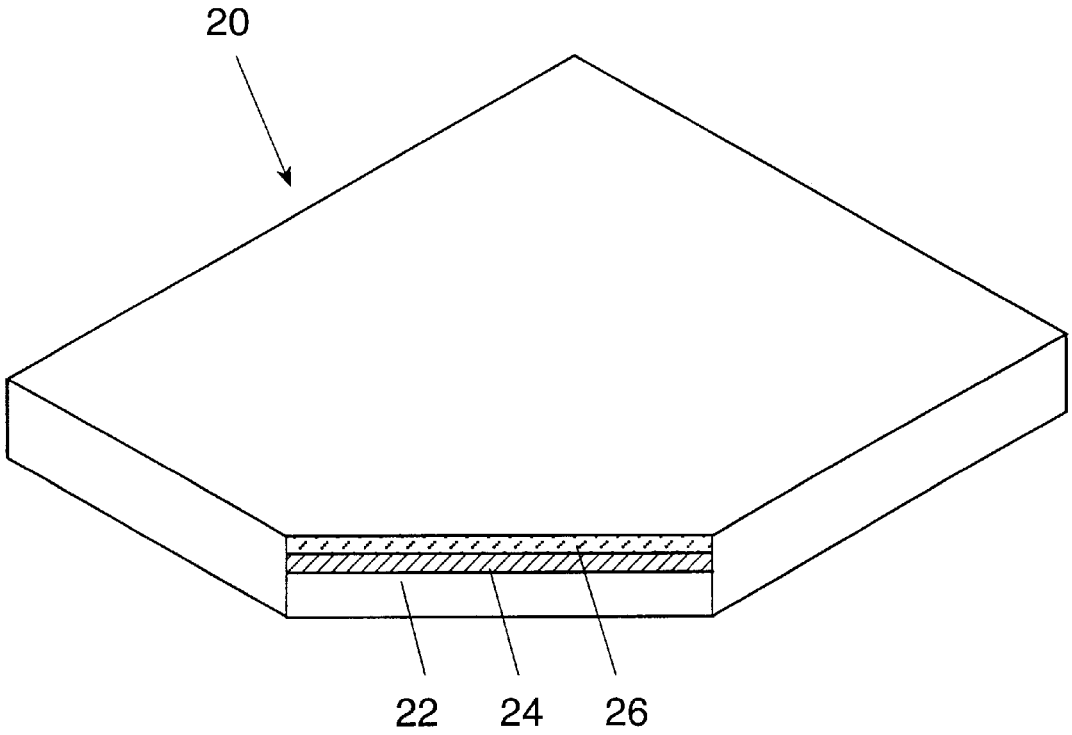
FIG. 1A is a perspective view a first embodiment of the present invention, including a partial cross-sectional view cut from a corner (the corner in broken lines)
Figure 1B:
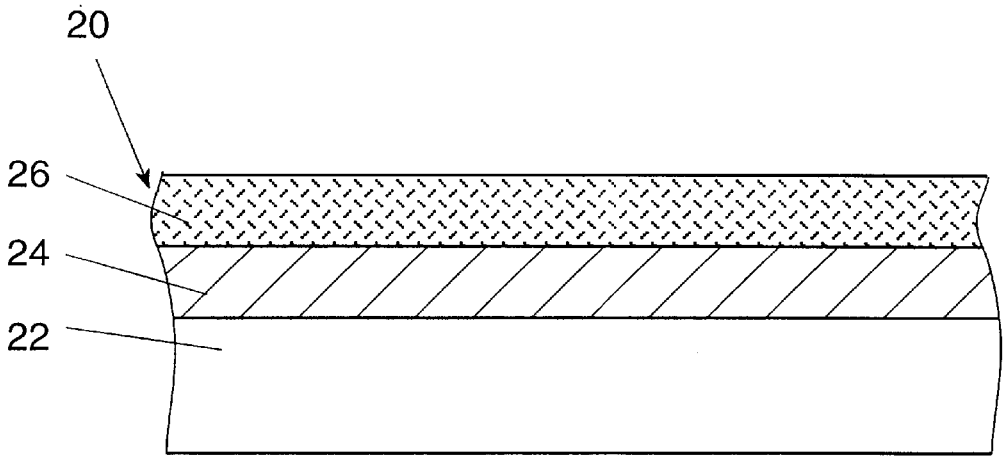
FIG. 1B is an enlarged cross sectional view of the cross section of FIG. 1A.

FIGS. 1A and 1B show a first embodiment of the printing member 20 of the present invention. The printing member 20 is preferably formed of at least three layers. A first, or substrate layer 22, forms a base or substrate for the printing member 20. A second layer 24, ablatable by preferably infra-red radiation, is over the first layer 22. A third surface coating layer 26, for absorbing radiation, preferably infra-red radiation, in order to facilitate ablation of the second layer 24, is over this second layer 24.

The first layer 22 is a base or substrate layer that supports the second 24 and third 26 layers. This first layer 22 carries the ink for transferring the image ablated into the printing member 20 (as discussed herein). Accordingly, it is oleophilic to the hydrocarbon-based ink or inks being used for the requisite printing process, to retain the ink used in transferring the image. The first layer 22 is preferably of a plastic material, such as polyester, some polyesters including MELINEX® polymer films from Imperial Chemical Industries, London, England, Product Numbers 339, 453, 505, 506, 542, 569, 725 and 742. This first layer 22 is preferably of a thickness of approximately 100 micrometers to approximately 300 micrometers.

The second layer 24 is of an ablatable material, and the desired image is formed in this second layer 24, preferably by ablation with infra-red radiation (detailed below). The ablatable material is preferably metal, in the form of a thin film of approximately 0.025 micrometers to approximately 0.1 micrometers thick. Preferred metals for the film include aluminum, chromium and nickel, or mixtures thereof, that are preferably placed onto the first layer 22 by vacuum deposition (evaporation), or other suitable metal thin film deposition techniques. This second layer 24 is also hydrophilic, such that when the printing member 20 is wetted with a water based fountain solution or the like, the second layer 24 that remains, post ablation and after the third layer 26 has been washed away or detached (see below), will be substantially abhesive to the hydrocarbon-based printing ink.

The third layer 26 is preferably a polymeric matrix loaded with an infra-red radiation absorbing material. This layer 26 couples with the material of the second layer 24, to permit ablation of the second layer 24 (the second layer 24, if uncovered, would normally reflect the infra-red ablative radiation). The preferred polymeric matrix is a composition of polyvinyl alcohol and methoxy methylol melamine, such as CYMEL® 373, available from Dyno-Cytec, K.S., Litlestrom, Norway, loaded with carbon black, the preferred infra-red radiation absorbing material. These materials form a layer of a thickness of approximately 0.5 micrometers to approximately 3.0 micrometers.

This third layer 26 may be water soluble, water miscible, or of low adhesion to the second layer 24, as to be easily removable by contact, typically wetting, with water-based fountain solution (fount), etchants, or a water wash. In addition, this third layer 26 is sufficiently thin (discussed immediately above), thus, further facilitating its ease of removal from the second layer 24. It is preferable to remove this third layer 26 that remains post ablation, prior to inking the printing member 20 (as described below), leaving an imaged printing member 20 with the first 22 and second 24 layers remaining.

The printing member 20 may be imaged by ablation with a low energy (approximately less than 1 Joule per square centimeter) infra-red laser, either on or off press. Alternately, imaging, preferably by ablation may be performed on press when the printing member 20 is incorporated into the system described in PCT Application No. IL97/00028, filed Jan. 22, 1997, entitled: AN IMAGING APPARATUS FOR EXPOSING A PRINTING MEMBER AND PRINTING MEMBERS THEREFOR, incorporated by reference herein. Ablation will substantially, and preferably completely, remove corresponding portions of the second 24 and third layers 26, leaving the desired image, or portion(s) thereof on the substrate layer 22, for carrying the hydrocarbon-based ink (s). The remaining third layer 26 will be removed (or detached) upon wetting, as detailed above, leaving an imaged printing member 20 with the first 22 and second layers 24 remaining, that is subject to inking. The now remaining hydrophilic second layer 24 accepts water or fount, upon wetting, making it substantially abhesive to the hydrocarbon-based ink(s), the ink(s) applied post wetting, and retained by the exposed portions of the first or substrate 22 layer. The now inked printing member 20 is ready for subsequent steps in the requisite printing operation.

Figure 2:
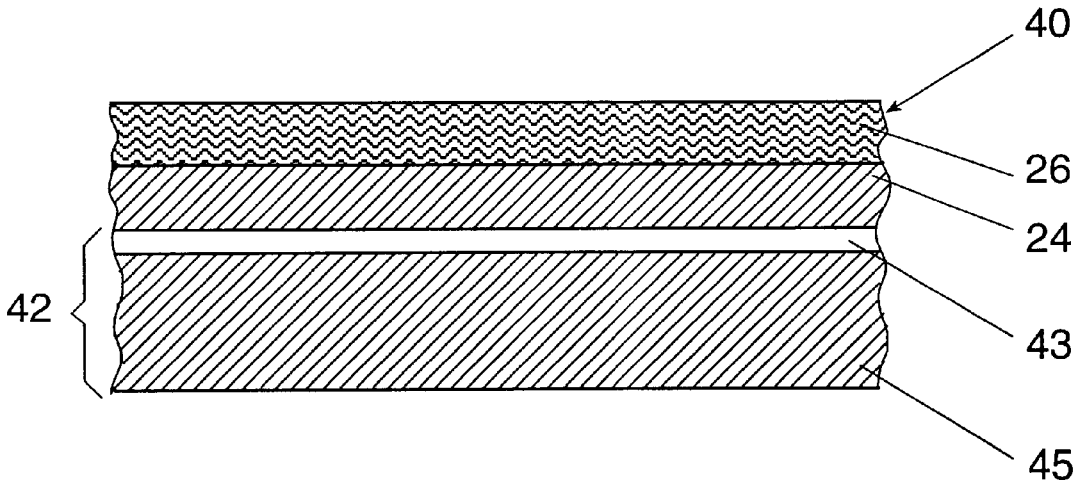
FIG. 2 is a cross sectional view of a second embodiment of the present invention.

FIG. 2 shows a second embodiment of a printing member 40 of the present invention. This second embodiment is similar in construction and materials to the printing member 20 described above, except that the first or substrate layer 42 is preferably formed of a first sub layer 43 and a second sub layer 45, bonded together.

The first sub layer 43 is preferably a polymeric layer, of materials including polyester, polycarbonate, polyimide or mixtures thereof. It may be in the form of a thin film, of approximately 40 micrometers in thickness.

The second sub layer 45 is preferably a metal layer, of materials including aluminum, chromium, nickel, or mixtures thereof. The metal for the sub layer 45 may be bonded onto the first sub layer 43 by adhesives or the like. This second sub layer 45 is relatively thick, approximately 200 micrometers in thickness, to provide the resultant printing member 40 with enhanced stiffness, making printing members in accordance with this second embodiment particularly suitable for large format offset printing press machines.

Ablation of this printing member 40 of this second embodiment, for imaging the substrate layer 42, is in accordance with that described for the first embodiment above. Additionally, removal of the third layer 26, by wetting or a water wash (as detailed above), preferably post ablation, subsequent wetting of the second layer 24 (as detailed above) inking of the printing member 40 and subsequent processing thereof, are in accordance with that described for the first embodiment above.

Figure 3:
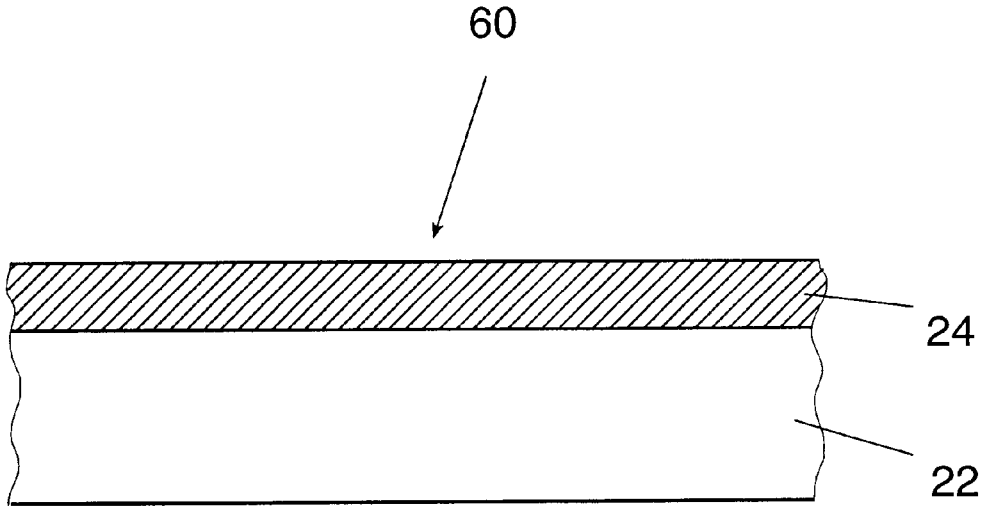
FIG. 3 is a cross sectional view of a third embodiment of the present invention.

FIG. 3 shows a third embodiment of a printing member 60 of the present invention. This printing member 60 is similar in construction and materials to the printing member 20 (FIG. 1B) of the first embodiment (described above), except that the third polymeric layer 26 (FIG. 1A) is not present in this embodiment. Rather, this printing member 60 has a first or substrate layer 22 preferably at a thickness of approximately 150 micrometers to approximately 300 micrometers, with a second layer 24, preferably of metal (as described above) over it. The second layer 24 is preferably of a thickness of approximately 0.025 micrometers to approximately 0.1 micrometers.

Additionally, this second layer 24 is designed to preferably retain an infra-red radiation absorbing ink or other similar material, such as black ink or cyan ink or the like, containing a suitable infra-red radiation absorbing dye or pigment, to facilitate ablation of corresponding portions of it and the second layer 24 (as discussed above).

Preferably, the printing member 60 is mounted on a conventional wet offset litho printing machine. The printing member 60 is then preferably covered by applying a thin film of black or cyan offset printing ink by means of ink form rollers, that receive the thin film of ink from an ink duct by an ink train of rollers. Imaging of this printing member 60 by ablation occurs as described above for the first embodiment.

Upon imaging, the ink remaining over the second layer 24 can be removed upon wetting with water-based fountain solution, etchants or a water wash, leaving an imaged printing member 60 (having first 22 and second 24 layers), similar to the printing members 20, 40, described above (with their respective third layers 26 removed). Subsequent wetting, inking and processing are in accordance with that for the printing members 20, 40 described above.

EXAMPLE 1

The following coating mixture was prepared. Initially, a first mixture of 3 grams of polyvinyl alcohol of approximate molecular weight of 22,000 was dissolved in 25 grams of hot distilled water. 2.5 grams of this first mixture were mixed with the following second mixture of components (all numbers designating parts in the mixture are in parts by weight of the entire mixture);

| | |
|---|---|
| CYMEL ® 373 (methoxymethyl methylol melamine - Dyno-Cytec K.S., Litlestrom, Norway) | 5.5 parts |
| Triton X-100 (iso-octylphenoxypolyethanol - BDH, Poole, Dorset, UK) | 0.1 parts |
| Direct Black 19 INA (aqueous black dispersion - Zeneca Corporation, Wilmington, Massachusetts) | 5.0 parts |
| Tintayd NV7137 (black acrylic dispersion from Daniel Products Company, Jersey City, New Jersey, USA) | 8.0 parts |
| Cycat 4045 (amine blocked p-toluene sulphonic acid from Dyno-Cytec-above) | 0.4 parts |
| Distilled water | 21.5 parts |

This second mixture was black in color, and the resultant coating mixture (the mixture formed from the above detailed first and second mixtures) was also black in color.

Previously, a sheet of aluminum coated polyester had been prepared. This sheet was a 150 micron thick polyester film with a thin layer of aluminum, forming an aluminum coating. The aluminum coating was placed onto the polyester film by vacuum evaporation.

The coating mixture was bar coated onto the aluminum surface of the aluminum coated polyester sheet to a dry weight of 1 gram per square meter. The coating mixture dried in a standard laboratory oven at 100° C. for one minute on the aluminum surface, forming a black coating layer, dry to the touch, on a now complete printing plate blank.

The printing plate blank was then imaged with infra-red radiation in accordance with that described in PCT Application IL 97/00028 (above). The plate blank had a sensitivity of approximately 800 millijoules per square centimeter. The coating layer was then washed off with water and the resulting plate blank was inked and run on a conventional offset lithographic machine, producing 3000 good quality copies.

EXAMPLE 2

The following mixture was prepared (all numbers designating parts in the mixture are in parts by weight of the entire mixture);

| | |
|---|---|
| Tintayd NV7137 (Example 1, above) | 17.6 parts |
| Distilled water | 62.5 parts |
| Triton X-100 (Example 1, above) | 0.6 parts |

The mixture was black in color.

The mixture was bar coated onto the aluminum surface of the aluminum coated polyester sheet of Example 1 (above) to a weight of 0.4 grams per square meter. The mixture dried on the aluminum surface and dried in accordance with that disclosed in Example 1 above, forming a black coating layer on a now complete printing plate blank. The now complete printing plate blank was imaged in accordance with Example 1 (above). After imaging, the remaining part of the black coating layer, was easily removed by washing with water. The resulting printing plate blank was employed in a print run on a conventional printing press.

EXAMPLE 3

The aluminum coated polyester sheet of Example 1 (above) was mounted on a printing press equipped with an on-press infra-red imaging unit. The aluminum surface was coated with STABILOX® black ink (available from Gebruder Schmidt, Germany) by activating the offset printing press with the fount system disengaged, to a uniform thickness of approximately 2 microns. The now ink coated aluminum coated polyester sheet (printing plate blank) was imaged on press, in accordance with the imaging method detailed in Example 1 (above). After imaging, the fount rollers were first applied to the printing plate blank and then a conventional wet offset lithographic printing process commenced.

While embodiments of the present invention have been described so as to enable one skilled in the art to practice the present invention, the preceding description is intended to be exemplary. It should not be used to limit the scope of the invention, which should be determined by reference to the following claims.

What is claimed is:

1. A printing member comprising:

a base, said base substantially oleophilic to at least one printing ink;

an infra-red radiation ablatable layer over said base, said infra-red radiation ablatable layer being hydrophilic and reflective to infra-red radiation; and an ablatable infra-red radiation absorbable covering for coupling with said infra-red radiation ablatable layer when said printing member is imaged, said covering being of a material dissolvable by water-based solutions and at least substantially removable from said printing member upon said dissolution.

2. The printing member of claim 1, wherein said infra-red radiation absorbing covering includes a polymeric material layer.

3. The printing member of claim 1, wherein said base includes a polymeric layer oleophilic to said at least one printing ink.

4. The printing member of claim 3, wherein said polymeric layer includes polyester.

5. The printing member of claim 3, wherein said base additionally includes a metal layer.

6. The printing member of claim 5, wherein said metal layer includes at least one metal selected from the group consisting of aluminum, chromium, nickel and mixtures thereof.

7. The printing member of claim 5, wherein said polymeric layer of said base is intermediate said infra-red radiation ablatable layer and said metal layer of said base.

8. The printing member of claim 1, wherein said infra-red radiation ablatable layer includes a metal.

9. The printing member of claim 8, wherein said metal is selected from the group consisting of aluminum, chromium, nickel and mixtures thereof.

10. A printing member comprising:

a base, said base substantially oleophilic to at least one printing ink;

an infra-red radiation ablatable layer over said base, said layer being reflective to infra-red radiation; and an ablatable infra-red radiation absorbing layer of a material dissolvable by water-based substances and substantially removable from said printing member upon said dissolution, said infra-red radiation absorbing layer over said infra-red radiation ablatable layer for coupling with the infra-red radiation ablatable layer, such that when at least a portion of said printing member is exposed to infra-red radiation, portions of said infra-red radiation absorbing layer and portions of said infra-red radiation ablatable layer, corresponding to said portions of said infra-red radiation absorbing layer are substantially removed.

11. The printing member of claim 10, wherein said base includes a polymeric layer oleophilic to said at least one printing ink.

12. The printing member of claim 11, wherein said polymeric layer includes polyester.

13. The printing member of claim 11, wherein said base additionally includes a metal layer.

14. The printing member of claim 13, wherein said polymeric layer of said base is intermediate said metal layer of said base and said infra-red radiation ablatable layer.

15. The printing member of claim 13, wherein said metal layer includes at least one metal selected from the group consisting of aluminum, chromium, nickel and mixtures thereof.

16. The printing member of claim 10, wherein said infra-red radiation ablatable layer is hydrophilic.

17. The printing member of claim 16, wherein said metal is selected from the group consisting of aluminum, chromium, nickel and mixtures thereof.

18. The printing member of claim 10, wherein said infra-red radiation ablatable layer includes a metal.

19. The printing member of claim 10, wherein said infra-red radiation absorbing layer includes a polymeric material.

* * * * *